United States Patent [19]

Flockenhaus et al.

[11] 4,222,824

[45] Sep. 16, 1980

[54] RECUPERATIVE COKE OVEN AND PROCESS FOR THE OPERATION THEREOF

[75] Inventors: Claus Flockenhaus, Essen; Edgar Hartkopf, Mülheim, both of Fed. Rep. of Germany

[73] Assignees: Didier Engineering GmbH, Essen, Fed. Rep. of Germany; Bergwerksverband GmbH, Essen-Kray, Fed. Rep. of Germany

[21] Appl. No.: 14,154

[22] Filed: Feb. 22, 1979

[30] Foreign Application Priority Data

Feb. 25, 1978 [DE] Fed. Rep. of Germany ..... 2808213

[51] Int. Cl.[2] ..... C10B 5/20

[52] U.S. Cl. ..... 201/41; 165/142; 202/122; 202/140; 202/148; 432/223

[58] Field of Search ..... 165/142; 432/223; 110/302; 201/41; 202/122, 140, 148

[56] References Cited

U.S. PATENT DOCUMENTS

| | | | |
|---|---|---|---|
| 1,051,875 | 2/1913 | Feicks | 202/140 |
| 1,392,257 | 9/1921 | Mathy | 202/140 |
| 2,841,383 | 7/1958 | Hazen | 165/142 X |
| 2,937,855 | 5/1960 | Hazen | 165/142 |
| 3,007,681 | 11/1961 | Keller | 165/142 X |
| 3,061,194 | 10/1962 | Nichols et al. | 165/142 UX |
| 3,849,258 | 11/1974 | Flockenhaus et al. | 202/140 |
| 4,106,556 | 8/1978 | Heyn et al. | 165/142 X |
| 4,151,874 | 5/1979 | Kaburagi et al. | 165/142 X |

FOREIGN PATENT DOCUMENTS

| | | | |
|---|---|---|---|
| 634648 | 9/1936 | Fed. Rep. of Germany | 165/142 |
| 748417 | 5/1944 | Fed. Rep. of Germany | 165/142 |

*Primary Examiner*—Frank W. Lutter
*Assistant Examiner*—Roger F. Phillips
*Attorney, Agent, or Firm*—Wenderoth, Lind & Ponack

[57] ABSTRACT

A recuperative coke oven includes at least one recuperator chamber arranged below an oven chamber. Hot undergrate firing exhaust gas is passed from the oven through the recuperator chamber. At least one elongated recuperator extends into the recuperator chamber. The recuperator includes an inner tube and a coaxially outer tube. The inner end of the inner tube is open, and the inner end of the outer tube is closed to define an annular chamber between the two tubes. Combustion air to be heated is introduced into the inner tube and passed therethrough. The combustion air then reverses direction and passes through the annular chamber and is thereat heated by the hot exhaust gas passing through the recuperator chamber. The heated combustion air is discharged from the annular chamber and passed to the heating flues of the oven. The length of the recuperator positioned within the recuperator chamber may be adjusted by relative sliding movement of the recuperator, to thereby change the available heat exchange surface of the recuperator and to thus regulate the temperature of the heated combustion air.

12 Claims, 1 Drawing Figure

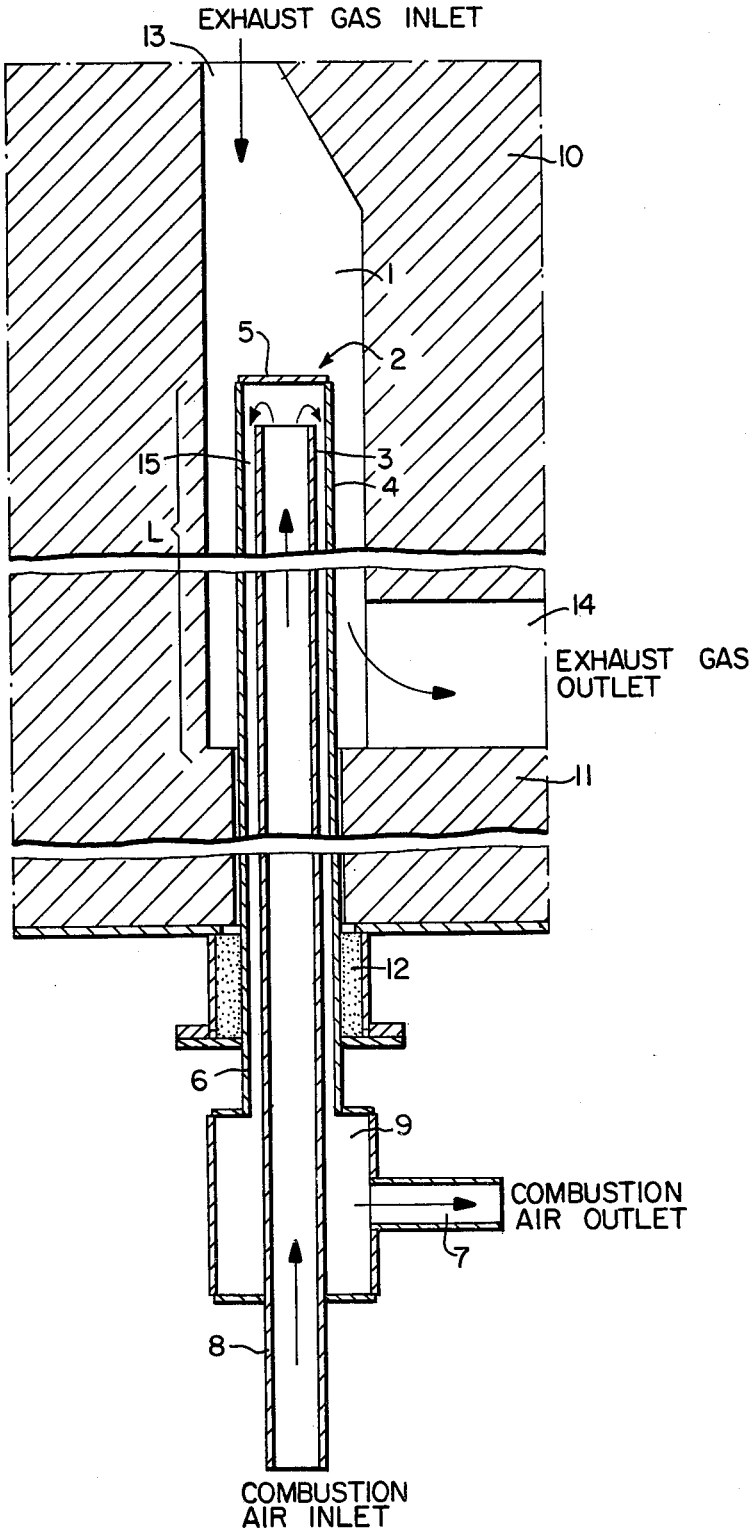
EXHAUST GAS INLET
13
10
1
5
2
15
3
4
L
14
EXHAUST GAS OUTLET
11
12
6
9
COMBUSTION AIR OUTLET
7
8
COMBUSTION AIR INLET

RECUPERATIVE COKE OVEN AND PROCESS FOR THE OPERATION THEREOF

BACKGROUND OF THE INVENTION

The present invention relates to a recuperative coke oven and to a process for the operation thereof.

The economy of a coke oven is to a very large degree influenced by the amount of energy required for the heating of the oven, i.e. by the economy of the undergrate firing consumption.

In a conventional regenerative coke oven, i.e. with a horizontal oven chamber with regenerative heat recovery, a constant amount of heat is normally supplied to the oven during the coking operation. However, as is known, the amount of heat required by the oven charge decreases from the beginning to the end of the coking period. Thus, the exhaust gas temperature increases, and this results in undesirably high exhaust gas heat losses. In order to overcome this disadvantage and to reduce fuel consumption, regenerative coke ovens have been adapted to include programmed or program controlled heating cycles, such as shown in DT-OS No. 20 11 261.

However, in a recuperative coke oven, in contrast to a regenerative coke oven, all of the heating flues are exposed to combustion. Thus, neither the heating flues nor the flue gas temperature can be influenced by means of re-adjustment of the heating phases (see for example DT-AS No. 21 64 994).

SUMMARY OF THE INVENTION

With the above discussion in mind, it is an object of the present invention to provide a recuperative coke oven and a process for the operation thereof, whereby it is possible to maximize the undergrate firing consumption by avoiding substantial heat losses.

This object is achieved in accordance with the present invention by the provision of a recuperative coke oven of the type including an oven chamber, heating flues, at least one recuperator chamber arranged below the oven chamber and defined by heating walls formed of fire-resistant brickwork, an exhaust gas inlet for introducing hot undergrate firing exhaust gas into the recuperator chamber, and an exhaust gas outlet for discharging exhaust gas from the recuperator chamber. At least one recuperator extends into each recuperator chamber. The recuperator includes an inner elongated tubular member and an outer elongated tubular member coaxially surrounding the inner tubular member and defining therebetween an elongated annular chamber. The inner tubular member has a first end positioned outside of the recuperator chamber and an open second end positioned within the recuperator chamber. The outer tubular member has a closed first end positioned within the recuperator chamber for closing the annular chamber and a second end positioned outside of the recuperator chamber.

Hot undergrate firing exhaust gas is passed through the exhaust gas inlet and into the recuperator chamber, and is then discharged from the exhaust gas outlet. Combustion air to be heated is introduced into the first end of the inner tubular member and is passed therethrough in a first direction. The combustion air discharges from the second end of the inner tubular member and then reverses direction and passes through the annular chamber between the two tubular members. The combustion air is heated within the annular chamber, predominantly by solid substance and gas radiation, by the hot exhaust gas passing through the recuperator chamber. The convective portion of the heating is minor. The thus heated combustion air is discharged from the annular chamber and is passed to the heating flues of the recuperative coke oven and is employed therein in an otherwise known manner to carry out a coking operation.

In accordance with a further feature of the present invention, the heated combustion air is discharged from the annular chamber into an expansion chamber and then to an outlet socket, and/or to collective piping, from which the heated combustion air is returned to the individual heating flues in measured quantities through known piping arrangements.

The recuperator is protected against overheating by the release of the preheated combustion air. Preferably, the inner and outer tubular members may be formed of a steel material. The maximum temperature of the tubular members is reduced by the direct parallel flow of combustion air and exhaust gas.

Each recuperator chamber is formed and defined by fire-resistant brickwork and can thus be utilized as a radiation chamber for heat transfer to the recuperator tubes. Each recuperator chamber may have therein a single recuperator or plural recuperators combined to form a common recuperator unit.

The present invention is particularly suitable for the two-stage economical cooling of the hot undergrate firing exhaust gases, as proposed in West German patent application No. P 27 15 536.8, wherein during a first stage a high radiation portion of the undergrate firing exhaust gases is employed for the preheating of combustion air in recuperators arranged beneath heating flues, and in a second stage the convective portion of the exhaust is employed in a heat exchanger, for example in a coal preheating plant. The recuperator of the present invention is particularly suitable for the utilization of the high radiation portion of the hot exhaust gas.

In accordance with a further feature of the present invention, the inner and outer tubular members of the recuperator extend substantially vertically into the recuperator chamber from the bottom thereof. Further, the exhaust gas inlet and the exhaust gas outlet are located such that the exhaust gas flows through the recuperator chamber in a direction substantially parallel to the flow of the combustion air through the annular chamber.

In accordance with a further feature of the present invention, the recuperator is positioned to slidably extend through a wall of the recuperator chamber, such that the effective length of the recuperator within the recuperator chamber may be adjusted. Thus, for the same temperature of the hot undergrate firing exhaust gas entering the recuperator chamber, more or less heat therefrom may be transferred to the combustion air in the recuperator. This adjustment is carried out as a function of the amount of heat required for the desired coking operation within the coke oven. More particularly, recuperative coke ovens have no transition phases during heating. Thus, there occur no substantial variations in the temperature of the exhaust and combustion draft. These stable conditions form a control variable for greater or lesser insertion of the recuperator into the recuperator chamber, to thereby expose a larger or smaller heat exchange surface and as a result to provide the temperature of the heated combustion air to be higher or lower, respectively. Measurement devices may be provided in the main ducts for the combustion draft to continuously monitor the air/fuel mixture and/or the introduction of combustion air and to regulate the adjustment position of the recuperator with respect to a predetermined nominal value. Such control is based on the necessary amount of heat to be introduced into the flues, dependent upon the quality of coke required for a particular coking operation. Such control may be achieved by means of a timer with built-in cam discs which generate preset time intervals for various increases in the heat output during a full coking operation.

BRIEF DESCRIPTION OF THE DRAWING

Other objects, features and advantages of the present invention will be apparent from the following detailed description, taken with the accompanying drawing, wherein:

The single FIGURE is a schematic vertical cross-section through a portion of a recuperative coke oven illustrating the novel recuperator of the present invention.

DETAILED DESCRIPTION OF THE INVENTION

With reference now to the drawing, there is shown a minor portion of a recuperative coke oven of the type including an oven chamber and heating flues (not shown). The oven includes therein at least one vertical recuperator chamber 1 defined by fire-resistant brickwork walls 10 and 11. An inlet 13 is provided for introducing hot undergrate firing combustion exhaust gas into recuperator chamber 1. An exhaust gas outlet 14 leads from recuperator chamber 1.

A preferably vertical recuperator 2 extends through a wall of recuperator chamber 1, preferably the bottom wall 11 thereof. Each recuperator chamber 1 of the recuperative coke oven may have therein a single recuperator 2 or a plutrality of recuperators.

The recuperator 2 includes an inner elongated tubular member 3 and an outer elongated tubular member 4 coaxially surrounding tubular member 3 and defining therebetween an elongated annular chamber 15. Inner tubular member 3 has an outer end positioned outside of the recuperator chamber for the introduction of combustion air to be heated. The inner tubular member 3 has an open inner end positioned within the recuperator chamber 1. The outer tubular member 4 has a closed inner end 5 positioned within the recuperator chamber and confronting the open inner end of the inner tubular member 3. Closed inner end 5 closes the annular chamber 15. The outer tubular member 4 has an outer end 6 positioned outside of the recuperator chamber 1 and connected to an outlet socket 7, for example by means of an expansion chamber 9.

During operation of the device, hot undergrate firing combustion exhaust gas is introduced into recuperator chamber 1 through inlet 13 and passes through the recuperator chamber 1 before discharge through exhaust gas outlet 14. Combustion air to be heated is introduced into inlet 8 and passes longitudinally vertically upwardly through the interior of inner tubular member 3. The combustion air is discharged from the inner open end of inner tubular member 3 and, as shown by the arrows in the drawing, reverses direction due to the closed end 5 of outer tubular member 4. The combustion air then passes vertically downwardly through annular chamber 15 and is heated by the exhaust gas. The thus heated combustion air is discharged from the annular chamber 15 and passes into expansion chamber 9. From there, the heated combustion air passes through outlet socket 7 from where it is then led into the heating flues of the oven and employed in a known manner to achieve a coking operation.

Preferably, the flow of the hot exhaust gas through the recuperator chamber 1 is in a direction parallel to the direction of flow of the combustion air through annular chamber 15.

In accordance with a particularly advantageous feature of the present invention, the recuperator 2 is mounted to slidably extend through wall 11 of the recuperator chamber. A sealing gasket 12 is provided on the exterior of wall 11 to surround recuperator 2.

Therefore, by sliding the recuperator 2 relatively into or out of the recuperator chamber 1, the effective length L of the recuperator within the recuperator chamber may be adjusted. Therefore, the effective heat exchange surface of the recuperator can be selectively changed. For example, if the recuperator 2 is pushed further into the recuperator chamber 1, then the temperature of the heated combustion air will be increased, with the exhaust gas inlet temperature at 13 and the combustion air inlet temperature at 8 remaining the same, and the exhaust gas outlet temperature at 14 will be reduced. In other words, the temperature of the heated combustion air supplied to the heating flues of the oven may be regulated as desired for a particular coking operation by relatively sliding the recuperator 2 into or out of the recuperator chamber 1. This allows for maximization of the consumption of heat of the undergrate firing exhaust gas.

Although a particularly preferred embodiment of the present invention has been described and illustrated herein, it will be understood that various modifications and changes may be made thereto without departing from the scope of the present invention.

What we claim is:

1. In a recuperative coke oven of the type including an oven chamber, heating flues, at least one recuperator chamber arranged below said oven chamber and defined by heating walls formed of fire-resistant brickwork, exhaust gas inlet means for introducing hot undergrate firing exhaust gas into said recuperator chamber, and exhaust gas outlet means for discharging exhaust gas from said recuperator chamber, the improvement comprising:

at least one recuperator extending into said recuperator chamber;

said recuperator comprising an inner elongated tubular member and an outer elongated tubular member coaxially surrounding said inner tubular member and defining therebetween an elongated annular chamber;

said inner tubular member having a first end positioned outside of said recuperator chamber for introducing combustion air to be heated into said inner tubular member, such that said combustion air flows through said inner tubular member in a first direction;

said inner tubular member having an open second end positioned within said recuperator chamber for discharging said combustion air from said inner tubular member;

said outer tubular member having a closed first end positioned within said recuperator chamber for closing said annular chamber, such that said combustion air discharged from said open second end of said inner tubular member is caused to flow through said annular chamber in a second direction opposite to said first direction, and said that said combustion air flowing through said annular chamber is heated by exhaust gas passing through said recuperator chamber from said exhaust gas inlet means to said exhaust gas outlet means;

said outer tubular member having a second end positioned outside of said recuperator chamber;

heated combustion air outlet means, connected to said second end of said outer tubular member, for discharging heated combustion air from said annular chamber; and means for regulating the temperature of the heated combustion air discharged from said heated combustion air outlet means by controlling the amount of heat taken from said exhaust gas passing through said recuperator chamber and said exhaust gas outlet means, said regulating means comprising means for mounting said recuperator to slidably extend through a wall of said recuperator chamber, such that the effective length of said recuperator within said recuperator chamber is adjustable.

2. The apparatus claimed in claim 1, wherein said heated combustion air outlet means comprises an expansion chamber, and an outlet socket connected to said expansion chamber.

3. The apparatus claimed in claim 1, wherein said inner and outer tubular members extend substantially vertically into said recuperator chamber from the bottom thereof.

4. The apparatus claimed in claim 1, wherein said exhaust gas inlet means and said exhaust gas outlet means are located such that said exhaust gas flows through said recuperator chamber in a direction substantially parallel to said second direction.

5. The apparatus claimed in claim 1, wherein said wall comprises a bottom wall of said recuperator chamber.

6. The apparatus claimed in claim 1, further comprising sealing gasket means surrounding said recuperator exterior of said recuperator chamber.

7. The apparatus claimed in claim 1, wherein said inner and outer tubular members are formed of steel.

8. A process for the operation of a recuperative coke oven of the type including an oven chamber, heating flues, and at least one recuperator chamber arranged below said oven chamber and defined by heating walls formed of fire-resistant brickwork, said process comprising:

passing hot undergrate firing exhaust gas from said oven through said recuperator chamber;

providing at least one recuperator extending into said recuperator chamber, said recuperator comprising an inner elongated tubular member and an outer elongated tubular member coaxially surrounding said inner tubular member and defining therewith an elongated annular member, said inner tubular member having a first end positioned outside of said recuperator chamber and an open second end positioned within said recuperator chamber, and said outer tubular member having a closed first end positioned within said recuperator chamber and closing said annular chamber and a second end positioned outside of said recuperator chamber;

introducing combustion air to be heated into said first end of said inner tubular member and causing said combustion air to pass therethrough in a first direction and then to discharge therefrom at said second end of said inner tubular member;

passing said combustion air to be heated from said second end of said inner tubular member through said annular chamber in a second direction opposite to said first direction and therein heating said combustion air by means of said hot exhaust gas passing through said recuperator chamber;

discharging the thus heated combustion air from said annular chamber adjacent said second end of said outer tubular member; and regulating the temperature of said heated combustion air discharged from said annular chamber by controlling the amount of heat taken from said hot exhaust gas passing through and being discharged from said recuperator chamber, said regulating comprising slidably extending said recuperator through a wall of said recuperator chamber and adjusting the effective length portion of said recuperator positioned within said recuperator chamber and exposed to said hot exhaust gas.

9. A process as claimed in claim 8, wherein said discharging comprises passing said heated combustion air through an expansion chamber and then through an outlet socket.

10. A process as claimed in claim 8, comprising passing said combustion air substantially vertically upwardly through said inner tubular member and substantially vertically downwardly through said annular chamber.

11. A process as claimed in claim 8, comprising passing said hot exhaust gas through said recuperator chamber in a direction substantially parallel to said second direction.

12. A process as claimed in claim 8, wherein said adjusting is carried out as a function of the amount of heat required for the desired coking operation with the coke oven.

* * * * *